United States Patent [19]

Kraus

[11] Patent Number: 5,033,930

[45] Date of Patent: Jul. 23, 1991

[54] GARBAGE COLLECTING TRUCK

[75] Inventor: Johann Kraus, Iserlohn, Fed. Rep. of Germany

[73] Assignee: Edelhoff Polytechnik GmbH & Co., Iserlohn, Fed. Rep. of Germany

[21] Appl. No.: 305,427

[22] Filed: Feb. 1, 1989

[30] Foreign Application Priority Data

Feb. 10, 1988 [DE] Fed. Rep. of Germany ..... 3804090

[51] Int. Cl.[5] ..... B65F 3/04

[52] U.S. Cl. ..... 414/408; 414/486; 414/555

[58] Field of Search ..... 414/404, 406, 408, 409, 414/486, 546, 555

[56] References Cited

U.S. PATENT DOCUMENTS

| | | | |
|---|---|---|---|
| 3,016,157 | 1/1962 | Brisson | 414/408 |
| 3,085,704 | 4/1963 | Dempster | 414/408 X |
| 3,765,554 | 10/1973 | Morrison | 414/408 |
| 4,057,156 | 11/1977 | Thompson et al. | 414/409 X |
| 4,175,903 | 11/1979 | Carson | 414/408 |
| 4,305,693 | 12/1981 | Naab | 414/408 X |
| 4,715,767 | 12/1987 | Edelhoff et al. | 414/408 |
| 4,722,658 | 2/1988 | Würtz et al. | 414/408 |

FOREIGN PATENT DOCUMENTS

| | | | |
|---|---|---|---|
| 0078011 | 5/1983 | European Pat. Off. | 414/408 |
| 2558466 | 7/1977 | Fed. Rep. of Germany | 414/406 |

*Primary Examiner*—Robert J. Spar
*Assistant Examiner*—John VandenBosche
*Attorney, Agent, or Firm*—Morgan & Finnegan

[57] ABSTRACT

A garbage collecting truck comprises a pouring unit, which has an open-topped pouring opening disposed between the driver's cab and the collecting container of the truck and also comprises a lifting and tipping apparatus consisting of at least one lifting arm, which is pivoted to the pouring unit or to the chassis of the vehicle on a transverse axis and which at its free end carries a transverse arm, which is parallel to said transverse axis and is pivotally movable between a pick-up region disposed in front of the driver's cab and a pouring region disposed above and behind the driver's cab. The transverse arm is provided with a claw for entering a receiving pocket of a garbage can and for picking up the can. A carrier which is provided with a drive and which is displaceable transversely to the longitudinal axis of the garbage collecting truck is provided on the truck below the lifting arm thereof. The carrier carries at least two suction cups at its outer end and is movable between an outer position, in which the suction cups can attract laterally disposed garbage cans, and an inner position, in which the suction cups are disposed in front of the claws and the receiving pocket of a garbage container which is attracted by suction is disposed above said claw.

7 Claims, 2 Drawing Sheets

GARBAGE COLLECTING TRUCK

BACKGROUND OF THE INVENTION

1. Field of the Invention

This invention relates to a garbage collecting truck comprising a pouring unit, which has an open-topped pouring opening located between the driver's cab and the collecting container of the truck and which also comprises a lifting and tipping apparatus consisting of at least one lifting arm which is pivoted to the pouring unit or to the chassis of the vehicle on a transverse axis and having at its free end a transverse arm, which is parallel to the transverse axis and pivotally movable between a pick-up region located in front of the driver's cab and a pouring region located above and behind the driver's cab. The transverse arm is provided with a claw for entering a receiving pocket of a garbage can and for picking up the can.

2. Description of the Prior Art

A garbage collecting truck of the kind described above is known from European Patent Publication 163 859 which corresponds to U.S. Pat. No. 4,715,767. In that truck the lifting arm consists of a rail on which a carrier provided with a drive is displaceably mounted. A transverse arm which is pivoted to the carrier is provided with the claw at its free end. When the claw of the known garbage collecting truck has been coupled to the garbage can, the means and drives for transversely displacing the carrier and for pivotally moving the pick-up arms which are movably mounted thereon must be raised as well with the carrier and the pick-up arm so that the garbage can may subsequently be tipped. Thus a substantial deadweight must be moved. This involves a loss of power and energy and also slows down the operation.

SUMMARY OF THE INVENTION

For these reasons it is an object of the invention to provide a garbage collecting truck which is of the kind described first hereinbefore and in which the deadweight which must be moved when a garbage can that has been coupled to the claw is lifted and is tipped to discharge its contents is reduced.

In a garbage collecting truck of the kind described first hereinbefore that object is accomplished in accordance with the invention by providing a carrier which is equipped with a drive and which is displaceable transversely to the longitudinal axis of the truck, being located thereon below the lifting arm thereof and which is provided with at least two suction cups at its outer end and which is movable between an outer position, in which the suction cups can attract laterally disposed garbage cans, and an inner position, in which the suction cups are disposed in front of the claws and the receiving pocket of a garbage container so that the container which is attracted by suction to the carrier is disposed above a claw. In accordance with the invention the means which are provided on the garbage collecting truck that serve to attract the garbage can and to transport the same to a position from which it can be picked up and tipped by the lifting and tipping apparatus are separated from the lifting and tipping apparatus and are closely connected to the truck itself. The lifting and tipping apparatus takes over the garbage cans when they have been attracted by the attracting and transporting means and moved by them to a pick-up position. Consequently, the means for attracting and transporting the garbage cans do not constitute a deadweight which must be moved by the lifting and tipping apparatus as it moves the garbage cans to their initial position for the tipping movement and the drives, particularly the hydraulic actuators, of the means for attracting and transporting the cans may be simpler because they are provided on the truck rather than on the pivoted lifting arms of the lifting and tipping apparatus. In addition, hydraulic lines connected to hydraulic cylinders used as drives may be stationary.

When it is desired to shift a garbage can which has been placed laterally of the garbage collecting truck, the carrier is laterally extended until its suction cups exert a suction force on a side wall of the can.

Suction cups for picking up garbage cans are known from Published German Application 25 58 466.

The suction cups may consist of pairs of vacuum cups, which are arranged one over the other on a rising arm which is angled from the carrier.

To permit an adjustment of the suction cups to the height of the garbage cans which have been position, the suction cups may be carried by a slide, which is provided with a drive and which is longitudinally slidably guided on the rising arm.

In accordance with a desirable feature two lateral lifting arms are provided, which have freely inwardly protruding arms, each of which carries a pick-up claw at each of its confronting inner end portions, and two carriers are provided, which carry suction cups and are adapted to be extended to mutually opposite sides. In such a case the garbage collecting truck is adapted to pick up and empty garbage cans which have been positioned on both sides of the truck and the operations on the left and right sides are independent of each other and may overlap each other in time so that the garbage can be collected at a higher rate.

The two separately controllable lifting arms may be interlocked or may be jointly controlled so that they can be raised and lowered in synchronism. If the lifting arms are interlocked, it is possible to empty large containers which have two receiving pockets. In such a case, the lifting arms may be interconnected by the container itself and by locking means which are provided on the lifting arms. Large containers having a cubic capacity in excess of 1 $m^3$ will desirably be picked up at their front end and are not previously moved to a central tipping position by the laterally extensible suction cups.

The pick-up claws have suitably the shape of a segment of a cone or pyramid having a section surface which is parallel to the axis of the cone or pyramid. The receiving pockets are suitably complementary to the claws. Pick-up claws and receiving pockets of that kind have been described, e.g., in German Utility Model 65 19 096.

In the attracting and lifting and tipping apparatus of a garbage collecting truck in accordance with the invention the means for attracting and the means for tipping are separate from each other so that smaller masses are required to be moved, the power requirement is reduced and the tipping times may be reduced too. In addition, the lifting arms may be used individually to tip relatively small garbage cans or jointly to tip relatively large garbage containers. In the latter case the coupling may be effected in a simple manner by the container.

During operations on the left and right, another garbage can can be picked from the roadside and moved to its tipping position by the transversely displaceable attracting mans as the previous garbage can is tilted.

DETAILED DESCRIPTION OF THE PREFERRED EMBODIMENT

Figure 1:
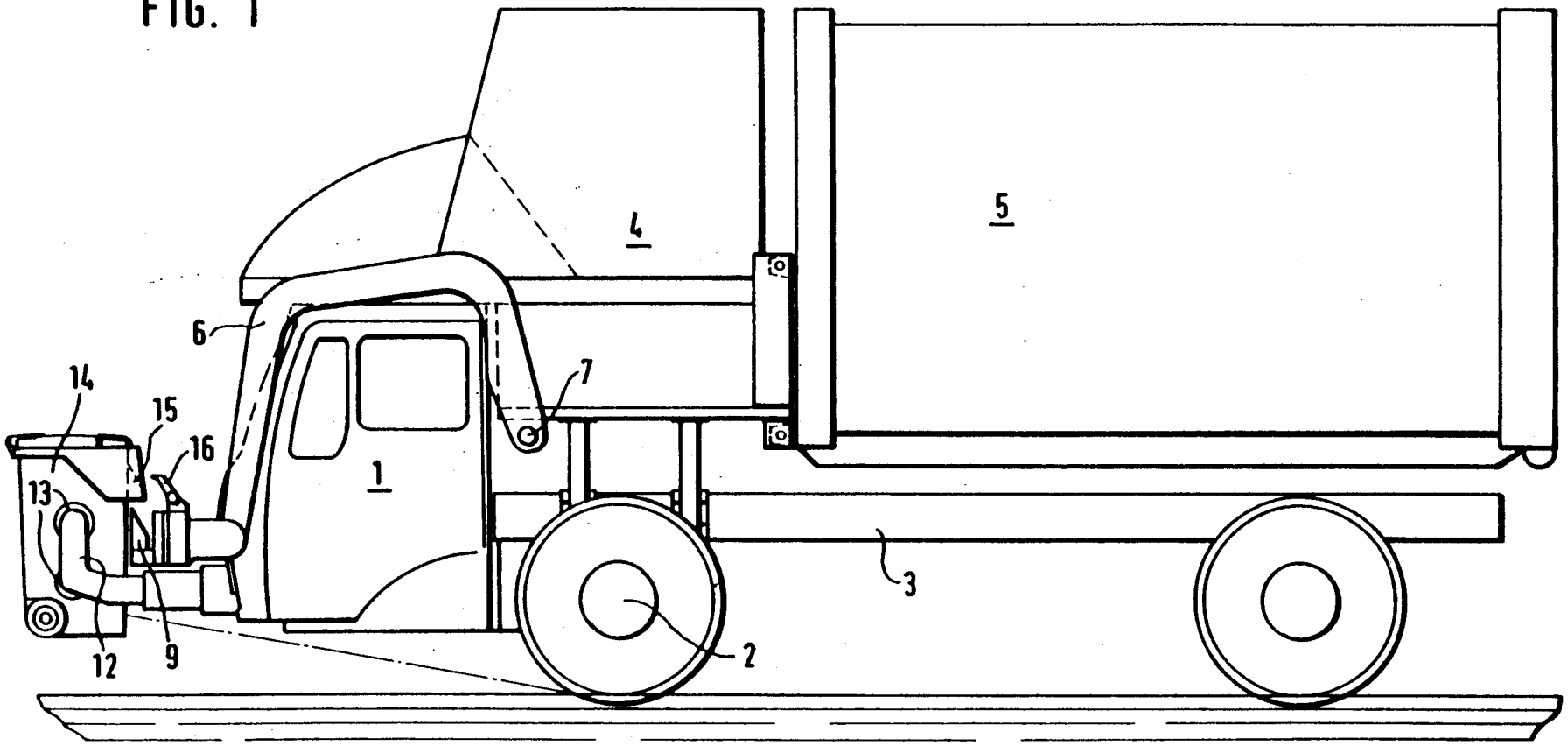
FIG. 1 is a side elevation showing only the right side of the pick up mechanism of a garbage collecting truck according to the invention.

An illustrative embodiment of the invention will now be explained more in detail with reference to the drawings.

The garbage collecting truck shown in the drawings has a short wheel base so that the truck will have high maneuverability for efficient collecting of garbage. The driver's cab 1 is secured to the main frame 3 of the chassis and is disposed in front of the front axle 2 on a low level such that the bottom thereof is adjacent to the level of the wheel axles or below that level, thus permitting the driver to easily see garbage cans which have been positioned at the roadside.

A pouring unit 4 is located in the chassis and is connected to the frame 3 in a manner such that it is disposed between the driver's cab and the collecting container 5 while also extending above the driver's cab 1.

Figure 2:
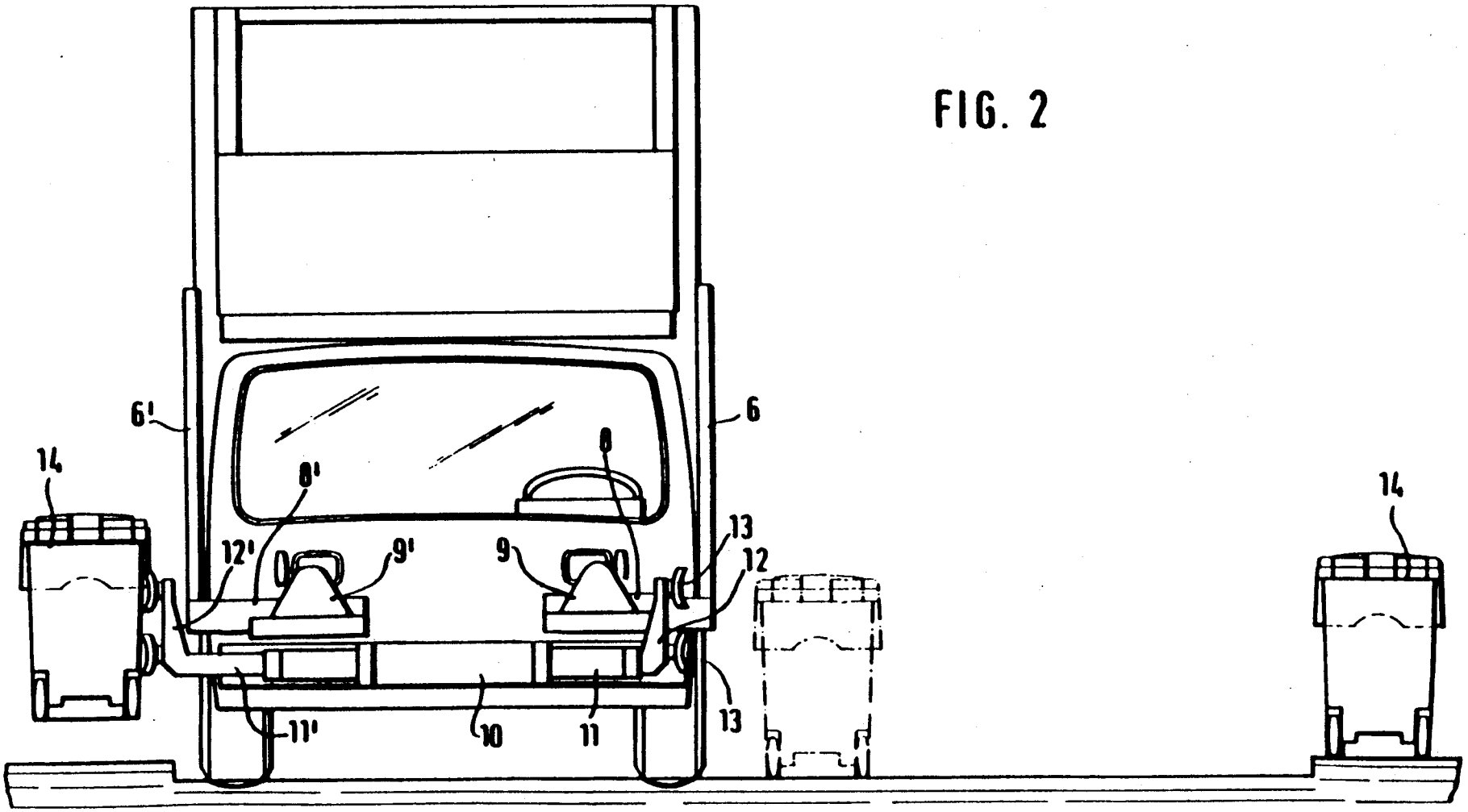
FIG. 2 is a front elevation of a garbage collecting truck according to the invention with both sides of the pick up mechanism shown.

The lifting and tipping apparatus comprises two U-shaped pivoted lifting arms 6, 6', (FIG. 2), which are disposed on both sides of the driver's cab and which have shorter arm portions which are pivoted on pivot 7 mounted behind the driver's cab on the lower portion of the pouring unit 4, or on the chassis. Freely inwardly protruding arms 8, 8', (FIG. 2), extend at right angles to the loner arm portions of the pivoted or lifting arms 6, 6' and are secured to the free ends of the longer arm portions. Adjacent to its inner end, each of the arms 8, 8' carries a pick-up claw 9 or 9' which has the shape of a triangle having an apex at its top. The pick-up claws 9, 9' have substantially flat rear surfaces and spherically curved front surfaces. As a result, a garbage can which has a complementary receiving pocket will be centered in all directions by a claw when the pocket has been fitted on the claw.

As is known, e.g., from European Patent Publication 163 859 which corresponds to U.S. Pat. No. 4,715,767, the lifting arms 6, 6' are pivotally movable by means of hydraulic cylinders connected thereto.

In their position of rest arms 8, 8' are aligned and disposed in front of the garbage collecting truck below the headlights. Transversely extending hydraulic cylinders 10 are provided below the arms 8, 8' and have piston rods 11, 11', which are extensible to both sides and at their free ends carry upwardly angled arms 12, 12'. Vacuum cups 13 are secured to the rising arms 12, 12' and when the piston rods have been extended serve to exert a suction force to attract garbage cans such as can 14 which have been positioned laterally of the truck.

When the garbage cans 14 have been attracted by the suction cups 13, the piston rods 11, 11', which may be telescopic, are retracted to move the garbage cans 14 to a position, shown in FIG. 1, above the triangular pick-up claws 9, 9'. From that position, they may be removed from the suction cups 13 by a movement which is imparted to the pick-up claws 9, 9' by an upward pivotal movement of the lifting arms 6, 6', so that the garbage cans 14 can subsequently be tipped.

As the lifting arms 6, 6' are pivotally moved, the pick-up claws 9, 9' enter the receiving pockets 15 of the garbage cans 14 as is shown in FIG. 1. The receiving pockets 15 are provided adjacent to the top rims of the garbage containers 14 and are complementary to the pick-up claws. When the pick-up claws have entered the receiving pockets 15, a locking member 16 falls into a locking position, in which it bears on the top rim of the receiving pocket 15 to hold the garbage can 14 in position as it is tipped upside down.

What is claimed is:

1. A garbage collecting truck comprising a pouring unit, which has an open-topped pouring opening disposed between the driver's cab and the collecting container of the truck, a lifting and tipping apparatus consisting of at least one lifting arm pivotal to said pouring unit or to the chassis of said truck on a transverse axis and which at its free end carries a transverse arm which is parallel to said transverse axis and pivotally movable between a pick-up region disposed in front of said driver's cab and a pouring region disposed above and behind said driver3 s cab, said transverse arm being provided with a claw for entering a receiving pocket of a garbage can and to pick up said can characterized in that a separate carrier having a separate drive and being linearly, slidably extensible transversely to the longitudinal axis of said truck on said truck below said lifting arm, said carrier including at least one upwardly angled arm, at least two suction cups carried by said carrier at the outer end of said upwardly angled arm and said carrier being linearly, slidably movable between an outer position, in which said suction cups can attract laterally disposed garbage cans, and an inner position, in which said suction cups are disposed in front of said claw and in which the receiving pocket of a garbage can attracted by suction of said suction cups is disposed above said claw.

2. A garbage collecting truck according to claim 1, characterized in that the suction cups are vacuum cups.

3. A garbage collecting truck according to claim 1, characterized in that the suction cups consist of a pair of vacuum cups arranged one over the other on the slide.

4. A garbage collecting truck according to claim 1, characterized in that the carrier is provided with a drive and is longitudinally displaceably guided on the rising arm.

5. A garbage collecting truck according to claim 1, characterized in that two lateral lifting arms are provided and said two lateral lifting arms have freely inwardly protruding arms, each of which carries a pick-up claw at each of its confronting inner end portions, and two carriers are provided which carry suction cups, said carriers being adapted to be extended to mutually opposite sides of said truck.

6. A garbage collecting truck according to claim 5, characterized in that the lifting arms and the carriers are adapted to be separately controlled.

7. A garbage collecting truck according to claim 5, characterized in that the lifting arms are adapted to be lifted and lowered in unison.

* * * * *